United States Patent [19]

Warshawsky

[11] Patent Number: 4,484,255

[45] Date of Patent: Nov. 20, 1984

[54] LAMP SWING ARM SUPPORT

[76] Inventor: Jerome Warshawsky, 1322 Everitt Pl., Hewlett Harbor, N.Y. 11557

[21] Appl. No.: 501,488

[22] Filed: Jun. 6, 1983

[51] Int. Cl.[3] ..... F21V 21/00; F21V 21/08

[52] U.S. Cl. ..... 362/396; 248/419; 362/269; 362/285; 362/413; 362/414; 362/419; 362/427

[58] Field of Search ..... 362/427, 396, 431, 450, 362/127, 86, 419, 432, 52, 413, 269, 285, 414; 248/419

[56] References Cited

U.S. PATENT DOCUMENTS

| | | | |
|---|---|---|---|
| 0,999,283 | 8/1911 | White | 362/427 |
| 1,178,359 | 4/1916 | Trammell | 362/427 |
| 4,390,933 | 6/1983 | Warshawsky | 362/427 |

*Primary Examiner*—Stephen J. Lechert, Jr.
*Assistant Examiner*—Howard J. Locker
*Attorney, Agent, or Firm*—Stephen E. Feldman

[57] ABSTRACT

A swing arm support housing is formed with a pair of openings spaced one from the other but each formed along parallel axis. One opening extends into but not through the housing and is on a size and configuration to be mounted on top of a lamp support post. The other opening extends completely through the housing and is fitted proximate each of its ends with aligned rings formed of a plastic material and retained in place by end rings. The aligned rings slidably and rotatably receive a lamp swing arm. At least one of such rings constitutes a clamping ring that has a longitudinal slit to permit distortion of the ring, proximate the slit and in a radial direction, to clamp same against the lamp swing arm to hold the swing arm in selected positions. A clamping actuator extends into the housing along an axis perpendicular to the axis of said openings and at a position proximate the second opening to coact with the clamping ring proximate its slit to compress the ring against the lamp swing arm or release the ring therefrom.

17 Claims, 4 Drawing Figures

LAMP SWING ARM SUPPORT

BACKGROUND OF THE INVENTION

1. Field of Application

This invention relates to lamp swing arm supports; and more particularly to supports, for lamp swing arms, which facilitate rotation and height adjustment of the lamp swing arm and its light source.

2. Description of the Prior Art

Many lamps include a support (wall bracket, floor base, table base, etc.) which locates the light source in a relatively fixed position. In some instances the light, from the light source, may not provide sufficient light to illuminate a desired area. Moving the light source closer to the area to be illuminated is not always possible. Wall bracket mounted lamps are substantially immovable. Table base mounted lamps cannot be moved too far from a table and may be too heavy or cumbersome to move; while floor base mounted lamps may also be too heavy or cumbersome to relocate.

Equipping a lamp with more bulbs, a three-way bulb, or a bulb with greater wattage, will increase the amount of illumination; but only at a greater expense for the added wattage. More importantly, it is not always more illumination that is desired; but sufficient illumination of a particular area.

Some degree of flexibility for relocating a lamp's light source is made possible by using a lamp with a light source carried by a swing arm that permits rotation of the light source about a vertical axis. An even greater degree of flexibility for relocating such a light source is possible in lamps where the swing arm mounting permits a vertical adjustment of the light source along the vertical axis in addition to the rotative movement of the light source about the axis.

However, most lamps which permit both a vertical and rotative adjustment of the light source with respect to a selected axis include a swing arm support that incorporates a clutch or clamping device to facilitate positioning of the swing arm with respect to the support post for the swing arm. Such supports, of the type shown in U.S. Pat. No. 1,854,932 granted on Apr. 19, 1932 to M. E. Gottlieb for Reflector Lamp, in U.S. Pat. No. 3,185,838 granted on May 25, 1965 to J. Warshawsky for Friction Controlled Slidable And Rotatable Mounting For Lamps and in U.S. Pat. No. 4,238,818 granted on Dec. 9, 1980 to A. Gindel for Nonrotatable Telescoping Supporting Structure, require rotation of a compression type nut to tighten and loosen the clutch or clamping device. Such a compression type nut may prove difficult to grasp, especially if ones hand is relatively small. Insufficient tightening of, or an inability to properly tighten, such a compression nut will result in slippage of the light support arm with respect to its support post and improper positioning of the light source. An inability to loosen such a compression nut will defeat the purpose of the support structure itself, i.e. the ability to re-position the light source on its support post. Additionally, such clamping devices may prove inefficient since they must convert an axially applied operating force into a radial clamping force.

Alternatively, supports of the type shown in U.S. Pat. No. 641,748 granted on Jan. 23, 1900 to T. Smith for Adjustable Bracket require a relatively complex and costly split support clamp or housing construction which must be aligned for prope use; and wherein if one half of the clamp is lost the entire support structure will be rendered useless.

Such available supports are also relatively short in their axial dimension and thus provide only support for only a relatively small portion of the arm or swing arm which supports the light source.

SUMMARY OF THE INVENTION

It is therefore an object of this invention to provide a new and improved lamp.

It is another object of this invention to provide a new and improved swing arm lamp.

It is yet another object of this invention to provide a new and improved support for a lamp swing arm.

It is still another object of this invention to provide a new and improved clamping mechanism for the support of a lamp swing arm.

It is yet still another object of this invention to provide a new and improved support housing for the support of a lamp swing arm.

These and other objects and advantages of the present invention will become evident from the description which follows, which includes other objects, features, and advantages of the invention, in its details of construction and arrangement of parts, which will be seen from the following description of the preferred embodiment, when considered with the drawings, and from the appended claims.

BRIEF DESCRIPTION OF THE INVENTION

This invention involves a lamp having a light source carried by a swing arm that is, in turn, mounted on a support post by a swing arm support which positions the swing arm for axial and rotational movement with respect to a swing arm axis and the support post, and contemplates forming the swing arm support of sufficient axial dimension to provide an extended support for the lamp swing arm; and providing the swing arm support with a clamping device that incorporates a clamping ring, and a clamping ring actuator which is moved in a direction perpendicular to the swing arm axis of rotation to apply a radial force to the clamping ring, which in turn grips the swing arm to secure the swing arm, and light source carried thereby, in position in the swing arm support and with respect to the support post.

The present invention thus generally entails the provision of a swing arm support housing which is formed with a pair of openings spaced one from the other, but each formed along parallel axes. One opening extends into, but not through, the housing, and is of a size and configuration to be mounted on top of a lamp support post. The other opening extends completely through the housing and is fitted proximate each of its ends with aligned rings formed of a plastic material and retained in place by end rings. The aligned rings slidably and rotatably receive a lamp swing arm. At least one of such rings constitutes a clamping ring that has a longitudinal slit to permit distortion of the ring, proximate the slit and in a radial direction, to clamp same against the lamp swing arm to hold the swing arm in selected positions. A clamping actuator extends into the housing along an axis perpendicular to the axis of said openings and at a position proximate the second opening to co-act with the clamping ring proximate its slit to compress the ring against the lamp swing arm or release the ring therefrom.

The present invention is thus basically characterized by the provision of a lamp swing arm support including support housing means; a first opening extending into the housing means along a first predetermined axis, and formed to a size and configuration to receive and be mounted to a lamp support post; a second opening extending through the housing means along a second predetermined axis, and formed to a size and configuration to receive a lamp swing arm; a third opening extending into the housing means along a third predetermined axis proximate the second opening, and formed to a size and configuration to receive a clamping actuator; a clamping ring disposed within the second opening, and formed of a size and configuration to slidably receive the lamp swing arm, and with a slit to facilitate radial movement of at least a predetermined portion of the clamping ring proximate the slit against the lamp swing arm, to clamp same in selected positions; and a clamping actuator movably received within the third opening, and having an actuator end movable into engagement with said clamping ring proximate said slit, to move the portion of the clamping arm when disposed therewithin, to so clamp the lamp swing arm in the selected positions.

In a preferred embodiment of the present lamp swing arm support, the first predetermined axis of the first opening and the second predetermined axis of the second opening are parallel to one another. In this case, typically the third predetermined axis is disposed at a predetermined angle with respect to the second predetermined axis. Preferably, this predetermined angle is 90°.

In other preferred modes, the first opening extends into, but not through, the support housing means. Generally, the clamping actuator includes a hand-turnable knob, and a clamping shaft connected thereto, and threadably received in threads formed in the third opening. Typically in this case, the clamping shaft is formed with a beveled forward edge disposed for co-action with an outer wall of the clamping ring. Preferably, the support housing is of predetermined axial dimension, so that a first end of the second opening is spaced a predetermined distance from a second end of the second opening, and the clamping ring is disposed proximate the first end of the second opening. In this embodiment of the invention, typically alignment ring means are provided proximate the second end of the second opening, and in spaced relationship to the clamping ring.

In a more specific embodiment of the present lamp swing arm support, the invention is characterized by the provision of a lamp, including a lamp base; a support post carried by the lamp base; a swing arm support carried by the support post; a swing arm carried by the swing arm support for rotative and sliding movement with respect thereto; and a light source carried by the swing arm. The swing arm support includes a support housing; a first opening extending into the housing along a first predetermined axis, and formed to a size and configuration to receive and be mounted to the support post; a second opening extending through the housing along a second predetermined axis, and formed to a size and configuration to receive the swing arm; a third opening extending into the housing along a third predetermined axis proximate the second opening and formed to a size and configuration to receive a clamping actuator; a clamping ring disposed within the second opening and formed of a size and configuration to slidably receive the swing arm and with a slit to facilitate radial movement of at least a predetermined portion of the clamping ring proximate the slit against the swing arm to clamp same in selected positions; and a clamping actuator movably received within the third opening and having an actuator end movable into engagement with the clamping ring proximate the slit, to move the portion of clamping ring against the swing arm when disposed therewithin, to so clamp the swing arm in the selected portions.

Typically, in a preferred embodiment of this configuration of the present lamp swing arm support, the first predetermined axis of the first opening and the second predetermined axis of the second opening are parallel to one another. In this version of the invention, the third predetermined axis is usually disposed at a predetermined angle with respect to the second predetermined axis, and preferably the predetermined angle is 90°. Generally, the clamping actuator includes a hand-turnable knob, and a clamping shaft connected thereto, and threadably received in threads formed in the third opening. In this case, typically the clamping shaft is formed with a beveled foward edge disposed for co-action with an outer wall of the clamping ring. In an alternative embodiment of this version of the invention, the support housing is of predetermined axial dimension, so that a first end of the second opening is spaced a predetermined distance from a second end of the second opening, and the clamping ring is disposed proximate the first end of the second opening. Typically in this case, alignment ring means are provided proximate the second end of the second opening, and in spaced relationship to the clamping ring, to provide spaced and aligned support means for the lamp swing arm.

The invention accordingly consists in the features of construction, combination of elements, and arrangement of parts, which will be exemplified in the device and article of manufacture hereinafter described, and of which the scope of application is as elucidated supra and as will be indicated in the appended claims.

DESCRIPTION OF THE PREFERRED EMBODIMENT

For convenience, the invention will be described as applied to a base mounted floor lamp with a tubular support post of circular cross section capped by a swing arm support that supports a tubular swing arm terminating in a semi-circular curved end that supports a substantially conical shade and a light source therewithin; it being understood, nevertheless, that without departing from the scope of this invention; that the lamp may be carried by a base and sized to be disposed upon a table, desk, pedestal or the like; that the support post need not be tubular or of circular cross-section; that the support post may extend through and above the swing arm support; that the swing arm can terminate with any selected one of numerous configurations; and that the shade may also be of any desired configuration.

Figure 1:
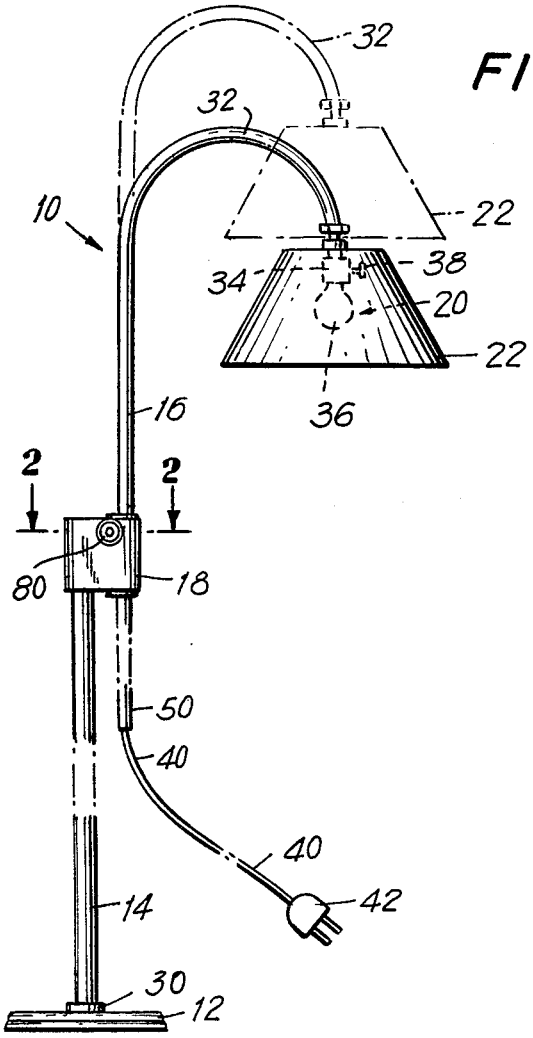
FIG. 1 is an elevational view of a lamp incorporating the instant invention.
Figure 2:
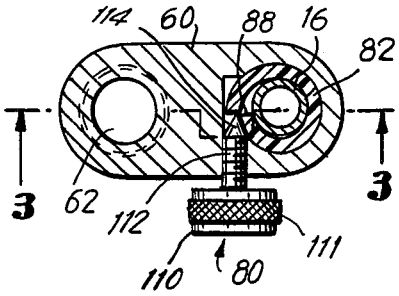
FIG. 2 is an enlarged sectional view taken along line 2—2 of FIG. 1.
Figure 4:
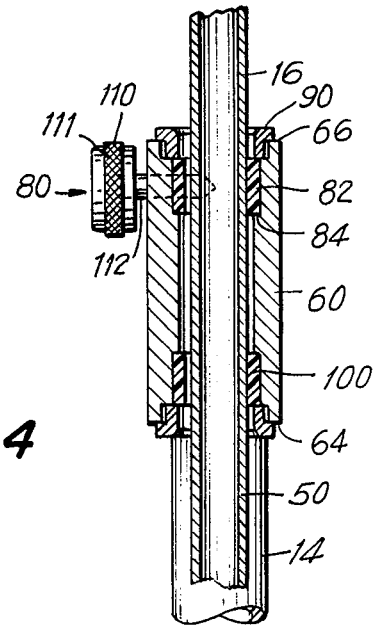
FIG. 4 is a sectional view taken on line 4—4 of FIG. 13.
Figure 3:
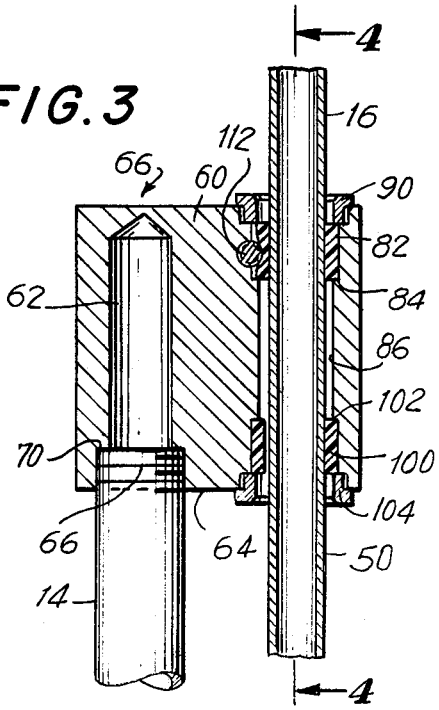
FIG. 3 is a sectional view taken along line 3—3 of FIG. 2.

With reference to FIG. 1, there is generally shown at 10 a lamp having a base 12, a vertically extending support post 14, a swing arm 16, a swing arm support assembly 18 interconnecting said support post 14 and swing arm 16, a light source 20, and a shade 22.

Support post 14 is formed from tubular stock and of a suitable material such as brass, steel, aluminum or the like. Post 14 is of circular cross-section but may be of any other convenient cross-section; and may also be formed from solid bar stock where suitable. An appropriate finish may be applied to the outer surface of post 14. The lower end 30 of post 14 is secured by suitable means to base 12 which is fabricated from a suitable material compatible with that of support post 14.

Lamp swing arm 16 is also formed of tubular stock of circular cross-section, and of a material corresponding to the material used for support post 14. A first end 32, of swing arm 16, is bent over into a semi-circular configuration and mounts a light source 20 in the form of a socket 34 and bulb 36. An appropriate and conventional electrical switch 38 is provided to turn light source 20 on and off, and to suitably connect socket 34, by way of electrical conductor 40 and a plug 42, to an appropriate source of electrical power. Electrical conductor 40 extends from light source 20 through swing arm 16 and out a second end 50 of swing arm 16.

Second end 50 of swing arm 16 is mounted to support post 14 through swing arm support assembly 18 (FIGS. 1–4). Support assembly 18 includes a housing 60 formed with a first opening 62 (FIGS. 2 and 3) extending into housing 60 from a first end surface 64 and terminating short of a second end surface 66 to thereby close-off opening 62. Opening 62 proximate end surface 64 is internally threaded to receive external threads 66 (FIG. 3) formed on the upper extremity of support post 14. A stop shoulder 70 is formed within opening 62 to provide a stop for inward movement of support post 14. Opening 62 may alternatively be formed to extend completely through housing 60 so as to be open at both ends and of a size to permit support post 14 to pass completely through. A suitable clutch or clamping device, such as clamping device 80 for swing arm 16, would be utilized to secure such swing arm mounting assembly in place on post 14.

Clamping device 80 includes a clamping ring 82 (FIGS. 2–4) seated against an upper shoulder 84 formed in a swing arm opening 86 that extends completely through housing 60 from first end 64 to second end 66 thereof. Opening 86 has an axis which parallels that of opening 62. Clamping ring 82 is formed from a suitable plastic or other material and with an axial slit 88 (FIG. 2) that splits ring 82 and facilitates radial deformation of ring 82. An end ring 90 is press fit into opening 86 to secure clamping ring 82 in place. The upper extremity of end ring 90 may be knurled around its periphery if desired. Clamping ring 82 permits sliding motion without scratching of the several parts.

A spacing ring 100 is seated against a lower shoulder 102 formed in opening 86 and is secured in place by a second end ring 104 also press fit into opening 86. Spacing ring 100 may be formed of suitable plastic and, in fact, may be identical to clamping ring 82 to minimize the number of different parts required to fabricate support assembly 18. The internal diameters of rings 82 and 90, their relative disposition, and the materials from which rings 82 and 90 are formed, permit an easy and aligned sliding action of swing arm 16 through support assembly 18 as long as clamping ring 82 is not radially distorted into the opening.

Clamping device 80 also includes a clamp actuator 110, formed with an externally threaded shaft 112 that is received in a suitably internally threaded opening extending into housing 60, and a knurled finger knob 111 to facilitate turning actuator 110. A forward end 114 (FIG. 2), of shaft 112 of actuator 110, is beveled and disposed to engage the outer wall of ring 82 proximate slit 88 thereof to thereby move that portion of ring 82 radially in towards swing arm 16 and against the surface thereof. When so moved with sufficient force swing arm 16 will be clamped in place within support assembly 18 and thus located in a predetermined rotative and axial position.

It should be noted that the line of movement of shaft 112, of clamping device 80, is along an axis that will not intersect with the axis of rotation and longitudinal movement for swing arm 16; and that such line of movement for shaft 112 is spaced from the axis of swing arm 16 so that an appropriate force is applied to clamping ring 82 to easily move same against swing arm 16. Retrograde movement of actuator 110 will just as easily move end 114 of actuator 110 away from clamping ring 82 and permit the inherent resilience of ring 82 to move ring 82 back towards its circular configuration and away from swing arm 16.

The axial dimension or height of support housing 60 provides a firm and aligned support for swing arm 16 to facilitate maintaining same in vertical alignment with support post 14.

In use one need only turn knob 110 in the appropriate direction to loosen clamping device 80. This action releases clamping ring 82 and permits rotative movement of swing arm 16 around its axis of rotation through opening 86. This action also permits axial movement of swing arm 16 along said axis of rotation to raise or lower light source 20. Subsequent turning of knob 110 in the opposite direction will move end 114 of shaft 112 against clamping ring 82 and compress same against swing arm 16 to clamp same in place.

It is important to note that while support post 114 has been shown of a size to permit placement of lamp 10 upon the floor that it may be just as easily sized to facilitate location of lamp 10 upon a table, desk or other pedestal. Alternatively, support post 14 may be suitably mounted to a wall bracket to support lamp 10 from a wall rather than a floor, desk, or other pedestal.

From the above description, it will thus be seen that there has been provided a novel and improved support assembly for mounting the swing arm and light source of a lamp, to the support post thereof; which support assembly is relatively simple in construction and easy to operate and provides an effective radially acting force against a clamping ring to maintain the lamp swing arm and light source in any selected rotative and axial position.

It is understood that although I have shown the preferred form of my invention that various modifications may be made in the details of thereof without departing from the spirit as comprehended by the following claims.

It will also thus be seen that there is provided a lamp swing arm support which achieves the various objects of the invention, and which is well adapted to meet the conditions of practical use. In this regard, numerous alternatives within the scope of the present invention will occur to those skilled in the art, besides those mentioned supra.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the patent statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention.

I claim:

1. A lamp swing arm support; comprising:

(a) support housing means;

(b) a first opening extending into said housing means along a first predetermined axis, and formed to a size and configuration to receive and be mounted to a lamp support post;

(c) a second opening extending through said housing means along a second predetermined axis, and formed to a size and configuration to receive a lamp swing arm;

(d) a third opening extending into said housing means along a third predetermined axis proximate said second opening and formed to a size and configuration to receive a clamping actuator;

(e) a clamping ring disposed within said second opening and formed of a size and configuration to slidably receive the lamp swing arm and with a slit to facilitate radial movement of at least a predetermined portion of said clamping ring proximate said slit against the lamp swing arm to clamp same in selected positions; and (f) a clamping actuator movably received within said third opening and having an actuator end movable into engagement with said clamping ring proximate said slit to move said portion of said clamping arm when disposed therewithin to so clamp the lamp swing arm in said selected positions.

2. The lamp swing arm support of claim 1, wherein said first predetermined axis of said first opening and said second predetermined axis of said second opening are parallel to one another.

3. The lamp swing arm support of claim 2, wherein said third predetermined axis is disposed at a predetermined angle with respect to said second predetermined axis.

4. The lamp swing arm support of claim 3, wherein said predetermined angle is ninety degrees.

5. The lamp swing arm support of claim 1, wherein said first opening extends into but not through said support housing means.

6. The lamp swing arm support of claim 1, wherein said clamping actuator includes a hand turnable knob and a clamping shaft connected thereto and threadably received in threads formed in said third opening.

7. The lamp swing arm support of claim 6, wherein said clamping shaft is formed with a beveled forward edge disposed for coaction with an outer wall of said clamping ring.

8. The lamp swing arm support of claim 1, wherein said support housing is of predetermined axial dimension so that a first end of said second opening is spaced a predetermined distance from a second end of said second opening, and said clamping ring is disposed proximate said first end of said second opening.

9. The lamp swing arm support of claim 8, wherein alignment ring means are provided proximate said second end of said second opening and in spaced relationship to said clamping.

10. A lamp; comprising:

(a) a lamp base;

(b) a support post carried by said lamp base;

(c) a swing arm support carried by said support post;

(d) a swing arm carried by said swing arm support for rotative and sliding movement with respect thereto;

(e) a light source carried by said swing arm;

(f) said swing arm support including:

(i) a support housing;

(ii) a first opening extending into said housing along a first predetermined axis, and formed to a size and configuration to receive and be mounted to said support post;

(iii) a second opening extending through said housing along a second predetermined axis, and formed to a size and configuration to receive said swing arm;

(iv) a third opening extending into said housing along a third predetermined axis proximate said second opening and formed to a size and configuration to receive a clamping actuator;

(v) a clamping ring disposed within said second opening and formed of a size and configuration to slidably receive said swing arm and with a slit to facilitate radial movement of at least a predetermined portion of said clamping ring proximate said slit against said swing arm to clamp same in selected positions; and (vi) a clamping actuator movably received within said third opening and having an actuator end movable into engagement with said clamping ring proximate said slit to move said portion of said clamping ring against said swing arm when disposed therewithin to so clamp said swing arm in said selected portions.

11. The lamp swing arm support of claim 10, wherein said first predetermined axis of said first opening and said second predetermined axis of said second opening are parallel to one another.

12. The lamp swing arm support of claim 11, wherein said third predetermined axis is disposed at a predetermined angle with respect to said second predetermined axis.

13. The lamp swing arm support of claim 12, wherein said predetermined angle is ninety degrees.

14. The lamp swing arm support of claim 10, wherein said clamping actuator includes a hand turnable knob and a clamping shaft connected thereto and threadably received in threads formed in said third opening.

15. The lamp swing arm support of claim 14, wherein said clamping shaft is formed with a beveled forward edge disposed for coaction with an outer wall of said clamping ring.

16. The lamp swing arm support of claim 10, wherein said support housing is of predetermined axial dimension so that a first end of said second opening is spaced a predetermined distance from a second end of said second opening, and said clamping ring is disposed proximate said first end of said second opening.

17. The lamp swing arm support of claim 16, wherein alignment ring means are provided proximate said second end of said second opening and in spaced relationship to said clamping ring to provide spaced and aligned support means for the lamp swing arm.

* * * * *

UNITED STATES PATENT AND TRADEMARK OFFICE

CERTIFICATE OF CORRECTION

PATENT NO. : 4,484,255

DATED : November 20, 1984

INVENTOR(S) : Jerome Warshawsky

It is certified that error appears in the above-identified patent and that said Letters Patent is hereby corrected as shown below:

On the title page "17 Claims" should read -- 20 Claims --.

Add the following claims:

18. The lamp swing arm support of claim 1 wherein the housing means is separate and apart from the the lamp shade.

19. The lamp swing arm support of claim 1 wherein the mounting is by a contact between housing means and the lamp support post.

20. The lamp swing arm support of claim 1, wherein the lamp swing arm and the lamp swing post are separate units.

Signed and Sealed this

*Twenty-third* Day of *April 1985*

[SEAL]

*Attest:*

DONALD J. QUIGG

*Attesting Officer* *Acting Commissioner of Patents and Trademarks*